US007337786B2

(12) United States Patent
Sonstegard et al.

(10) Patent No.: US 7,337,786 B2
(45) Date of Patent: Mar. 4, 2008

(54) ELASTIC HAIR STYLING DEVICE

(75) Inventors: Lois J. Sonstegard, Minneapolis, MN (US); Roger A. King, Sandpoint, ID (US)

(73) Assignee: LJL, Inc., Minneapolis, MN (US)

( * ) Notice: Subject to any disclaimer, the term of this patent is extended or adjusted under 35 U.S.C. 154(b) by 269 days.

(21) Appl. No.: 11/071,883

(22) Filed: Mar. 3, 2005

(65) Prior Publication Data

US 2005/0194018 A1 Sep. 8, 2005

Related U.S. Application Data

(60) Provisional application No. 60/549,846, filed on Mar. 3, 2004.

(51) Int. Cl.
*A45D 8/00* (2006.01)
*A44B 1/18* (2006.01)

(52) U.S. Cl. ..... 132/273; 24/686

(58) Field of Classification Search ..... 132/273, 132/275, 277–280; 24/136 K, 682.1, 686, 24/298, 301–302, 3.13, 662, 615, 618–619
See application file for complete search history.

(56) References Cited

U.S. PATENT DOCUMENTS

| | | | | |
|---|---|---|---|---|
| 1,024,566 | A | 4/1912 | Gifford | |
| 1,538,809 | A | 5/1925 | Henry | |
| 1,945,932 | A | 2/1934 | Caley | |
| 2,011,194 | A * | 8/1935 | Eisler | 132/273 |
| 2,378,872 | A | 6/1945 | Stone | |
| 2,415,914 | A | 2/1947 | Silverman | |
| 2,488,954 | A * | 11/1949 | Winters | 132/275 |
| 2,969,070 | A | 1/1961 | Todfield | |
| 3,099,271 | A * | 7/1963 | Dubelier | 132/273 |
| 3,301,266 | A | 1/1967 | Hoffmann | |
| 3,751,769 | A | 8/1973 | Reiner | |
| 4,161,806 | A | 7/1979 | Hennisse et al. | |
| 4,922,986 | A * | 5/1990 | Leibowitz | 160/178.1 V |
| 4,972,859 | A | 11/1990 | Noviello, Jr. et al. | |
| 5,230,355 | A * | 7/1993 | Weingrod | 132/275 |
| 5,409,330 | A * | 4/1995 | Naines et al. | 403/292 |
| 5,535,765 | A | 7/1996 | Takashima | |
| 5,890,494 | A | 4/1999 | Sonstegard | |
| 5,913,319 | A | 6/1999 | Tsai | |
| 6,189,543 | B1 | 2/2001 | Sonstegard | |
| 6,401,726 | B1 | 6/2002 | Sonstegard | |
| 2004/0149305 | A1 * | 8/2004 | Tsai | 132/273 |

FOREIGN PATENT DOCUMENTS

| | | |
|---|---|---|
| GB | 2 316 001 A | 2/1998 |

* cited by examiner

*Primary Examiner*—Robyn Doan
(74) *Attorney, Agent, or Firm*—Kinney & Lange, P.A.

(57) ABSTRACT

A hair styling device with a stretchable, relatively long body portion extending between two ends thereof having a first end clasp member and a second end clasp member each provided at a corresponding one of the opposing ends thereof capable of being at least in part positionable about at least a part of the other. The first and second end clasp members each have a passageway therethrough into which a corresponding body portion end extends with the body portion ends each having a passage blocking object thereon, and being sufficiently narrow to prevent the body end extending therethrough with a blocking object thereon from passing through that narrow part. The blocking member can be a spherical shaped solid wedging the body portion ends into a tapered sides portion of the passageway in each clasp member.

14 Claims, 2 Drawing Sheets

ELASTIC HAIR STYLING DEVICE

CROSS-REFERENCE TO RELATED APPLICATION(S)

This application claims the benefit of Provisional Application No. 60/549,846 filed on Mar. 3, 2004 for "ELASTIC HAIR STYLING DEVICE".

BACKGROUND OF THE INVENTION

The present invention relates to hair styling devices, namely devices for forming French knots, buns and the like, and in particular, to stretchable hair styling devices.

Long hair styles are popular with people of all ages, particularly with women. Because of the popularity of long hair styles, several devices have been invented for styling long hair. Examples include barrettes, hair ties, combs and ornamental hair pins.

Concerning hair styling devices that are currently known, there are included a few devices which are useful for styling long hair into a bun, a French knot, or similar style.

One such device is a soft sponge-like ring. The ring is covered with a fine netting material, which can be used by drawing the hair through the opening in the sponge, wrapping the hair around the ring and securing the hair onto the ring by trapping the hair and the netting material together with hair pins. The ring can also be formed from a fabric, such as woven nylon covered with a nylon netting. Typically, the ring has an outer diameter of approximately four inches and has an inner diameter of approximately two inches.

There are disadvantages in using a soft sponge-like ring to form a hair bun. Smooth, thick hair is difficult to wrap around the ring, pin the hair down and have the hair remain in place. Wrapping the hair around the ring is also quite time consuming when the hair is long. Shorter hair may not be possible to wrap completely around the ring.

There are flexible combs that are known having two ends which can be opened to install the comb around the hair, and then closed to form a substantially circular ring. Flexible combs have many sharp, pointed edges which can scrape the scalp. Such a comb is also not particularly useful for styling hair into a bun. The flexible combs described above are primarily intended to be used to form French knots.

Women have also used rubber bands or cloth covered elastic bands to hold either all the hair in a ponytail or knot or to form small sections of hair into ponytails or knots. The devices currently available are closed loops that have no clasping device built into them. The end-user simply wraps the rubber band or cloth covered band one or more times around the hair to hold it in place. If jewelry is attached, the jewelry is either glued to the elastic loop or the elastic loop is drawn through a closed opening in some part of the jewelry or jewelry mounting arrangement therein to hold the jewelry in place. Often, removing the band is somewhat difficult and leads to pulled hair.

There is also known a hair styling device including a flexible elongated body portion having a first end with a press capture clasp portion, a second end with the remaining press capture clasp portion and an elongated slit opening extending through a central portion of the elongated body for receiving hair through the slit opening. This elongated portion, though flexible, further elongates only a relatively limited amount so that it cannot be stretched and wrapped about the hair more than once to thereby provide tension therein to hold the hair more tightly.

There are currently no known hair styling devices which can be used to rapidly and easily form, and disengage from, a tight French knot, bun or similar hair style, and to which a hair styling enhancement, such as a flower or other ornament, may be optionally attached to the hair styling device with an attachment accessory.

BRIEF SUMMARY OF THE INVENTION

The present invention provides a hair styling device for styling a person's hair through being wrapped about a portion thereof having a stretchable, relatively long body portion extending between two ends thereof. In addition, a first end clasp member and a second end clasp member are provided each at a corresponding one of the opposing ends of the body portion with a selected one of the first and second end clasp members having an open region therewith large enough to receive therein at least a part of the other so to be at least in part positionable about at least a part of the other so as to each capture the other and to remain so positioned against a selected amount of force subsequently occurring that tend to pull them apart. The first and second end clasp members each have a passageway therethrough into which a corresponding body portion end extends with the body portion ends each having a passage blocking object thereon.

The first and second end clasp members passageways each have at least a part of which that is sufficiently narrow to prevent the body end extending therethrough with a blocking object thereon from passing through that narrow part. The blocking member can be a spherical shaped solid wedging the body portion ends into a tapered sides portion of the passageway in each clasp member.

DETAILED DESCRIPTION

Figure 1:
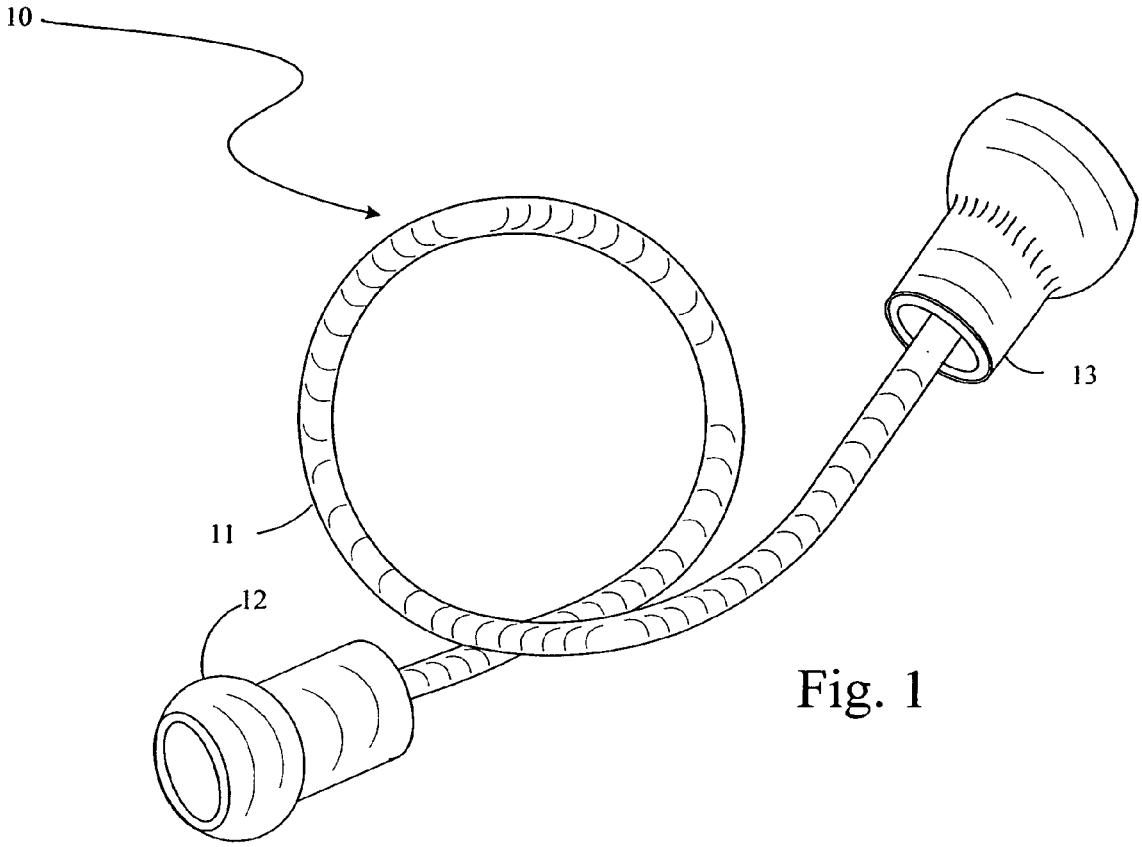
FIG. 1 shows a perspective view of an embodiment of the present invention.

The hair styling device, 10, of the present invention is shown in the perspective view of FIG. 1 and has a cloth covered elastomeric band, 11, with each end thereof anchored in a corresponding one of two clasp portions, 12 and 13, that snap together and snap apart but remain together under the tension introduced therein by wrapping band 11 one or more times about an aggregation of the user's hair. The materials used in this device as seen in these figure for clasp portions 12 and 13 are polymers such as polypropylene or polyvinyl chloride or high density polyethylene (HDPE), or some combination thereof, chosen to provide a suitable combination of resiliency and hardness to allow the clasp portions to snap together, and so stay together against a degree of tensile force, but still be separable from one another by the user. The cloth covered elastomer has a very large rubber-like elasticity for band 11, and is surrounded by a braided cloth that can stretch in the direction of elongation of the elastomer but to a limit which is short of the failure point in stretching of the elastomer so as to thus limit the elongation of band 11.

Clasp portions 12 and 13 (male and female ends, respectively), of these materials, are sufficiently resilient to permit the engagement of one with the other, and the disengagement of one from the other, but with a resiliency also permitting the maintaining of sufficient rigidity and shape during use so as to accomplish their joint clasping function even against tensile forces attempting to separate them. Female end 13 must be able to hold male end 12 rather tightly because the tension introduced in elastomeric band 11, after its being wrapped about an aggregation of the user's hair to thereby hold that hair, can be considerable. Nevertheless, the capability of male and female clasp portions 12 and 13 to be separated by the user allows both removal of the device from that hair to occur conveniently, and further allows the insertion of a decorative jewelry item even after the device clasp portions have been previously joined together following the wrapping of the elastomeric band about some of the user's hair.

Figure 2A:
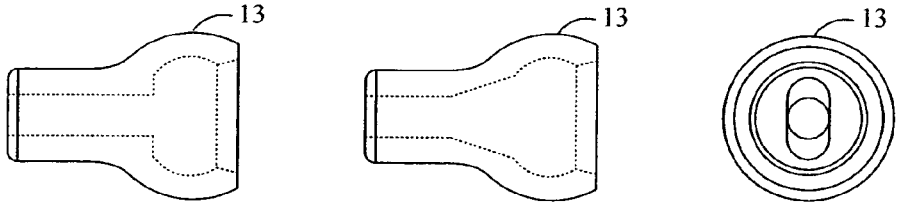
FIGS. 2A and 2B show side views of portions of the embodiment in FIG. 1 in greater detail.
Figure 2B:
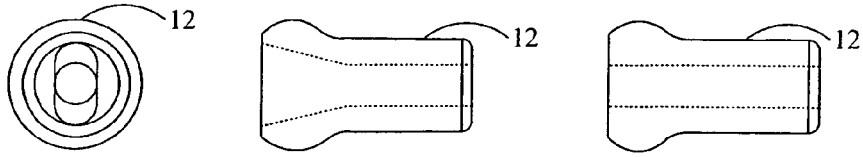

FIGS. 2A and 2B more detailed side and end views of clasp portions 12 and 13. Thus, FIG. 2A shows two side views of female clasp portion 13, such that one of these views is rotated 90° from the other, and an end view on the left of the right side ends of these first two views. Female clasp portion 13 has on the right end thereof a hollow interior capturing portion shaped somewhat like a truncated spherical shell into which male clasp portion 12 can be inserted, and further has a band fixation portion shaped more or less like a cylindrical shell extending out from the truncated spherical shell portion to the left therefrom. The material forming the sides of the capturing portion of clasp portion 13 about the hollow therein must be resilient enough to permit enough radial stretching of the capturing portion walls about the clasp end opening in the capturing portion so as to permit forcing the corresponding portion for capture of male clasp 12 into that hollow and then permit recovering from that opening dimensional stretch through the subsequent radial contracting of those sides thereby leading to snugging the sides of the capturing portion about the hollow therein against the inserted portion of male clasp 12.

A round passageway extends through the interior of this cylindrical shell portion from the hollow interior of the capturing portion, and has a smaller diameter starting from the left than the parallel diameters of this hollow (as seen in the left view in FIG. 2A), but, further on, has two opposite side portions which, rather than being parallel to the passageway axis, are in a rounded taper at about 22° in extending from the capturing portion hollow to reach the diameter of the round passageway in the cylindrical band fixation portion (as seen in the middle view in FIG. 2A). This passageway permits cloth covered elastomeric band 11 to be pulled therethrough to permit the end of that band to be altered in a selected manner so that it cannot pass through this smaller diameter portion.

Thus, a knot can be tied in the end of band 11 and pulled back into the tapered side portion of this passageway to thereby be out of the interior of the spherical shell portion but still anchored in the passageway through being unable to pass through the small diameter portion thereof. Alternatively, a metal or polymer ball or clip can instead be placed on that end of elastomeric band 11 and pulled back into the tapered side portion of this passageway. The cylindrical band fixation portion also enables the user of the styling device to conveniently hold onto female clasp portion 13 when connecting together clasp portions 12 and 13 or when disconnecting them from one another.

Figure 3:
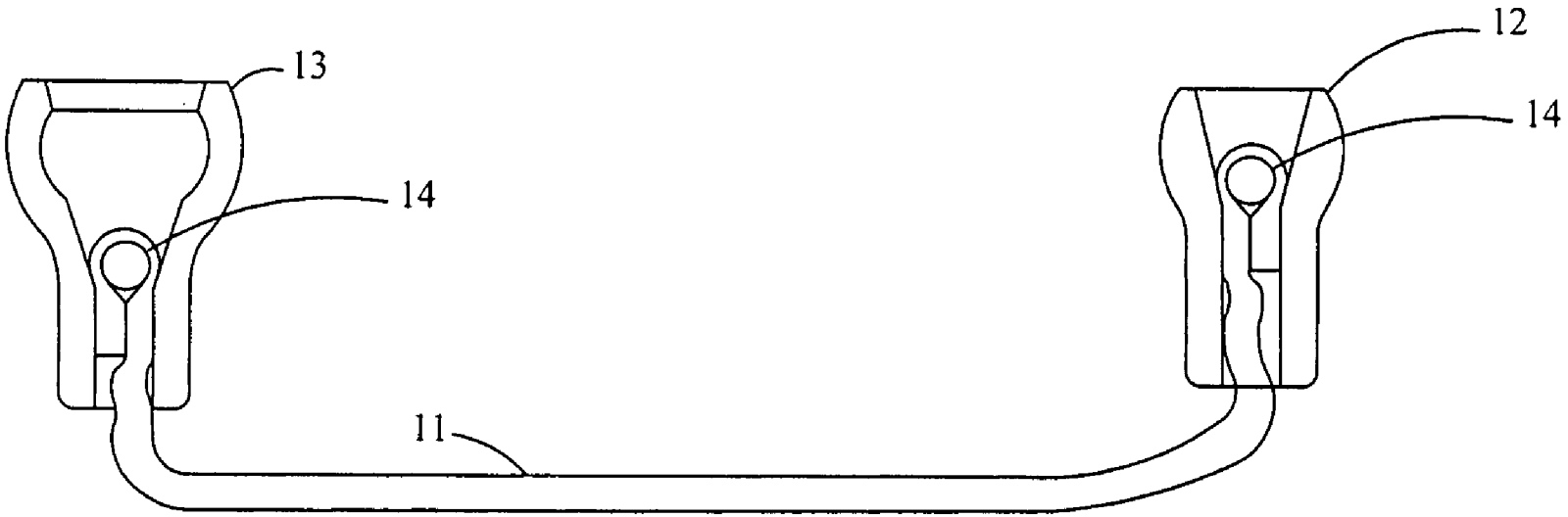
FIG. 3 shows a side view of the embodiment shown in FIG. 1 including partial cross sections.

Placing a metal ball on the end of elastomeric band 11 can be accomplished by affixing that ball to the end of band 11, as an example, by having an opening in the ball in which an end portion of band 11 is inserted and bonded there by a suitable adhesive. Alternatively, such a metal ball can be wedged against parts of such an end portion of band 11 in the interior of the cylindrical shell portion of female clasp portion 13 as shown in FIG. 3 by forming a loop in band 11 outside, or partially outside, of the clasp capturing portion, while leaving the terminal end of the band in the tapered portion of the passageway, and then inserting the metal ball in the loop so formed. Then, by drawing main remaining portion of band 11 back out of the passageway opening at the end of the band fixation portion to thereby draw the band loop and metal ball into the tapered portion of the passageway, band 11 is wedged against the sides of the tapered side portion of the passageway by the metal ball. The diameter of the metal ball must be less than the distance between the most widely separated opposite sides of the passageway at the tapered sides portion located where the passageway continues toward the band fixation portion from the capturing portion hollow but about the same diameter as the diameter of the round passageway between the end of the tapered sides portion of that passageway and the clasp passageway end in the band fixation portion on the left in the left and middle views in FIG. 2A.

FIG. 2B shows two side views of male clasp portion 1, such that again one of these views is rotated 90° from the other, and an end view on the left of the left side ends of these first two views. Male clasp portion 12 also has a passageway through it, and has on the left end thereof a rounded tapered side interior capture portion, shaped somewhat like a truncated spherical shell for insertion into the hollow in female clasp portion 13. In addition, male clasp portion 12 has a band fixation portion shaped more or less like a cylindrical shell extending out from the truncated spherical shell portion to the right therefrom. The passageway is round in extending through the interior of this cylindrical shell portion from the tapered side interior of the capture portion, and has a smaller diameter starting from the right than the distance between the most widely separated opposite sides of the passageway at the tapered sides portion located at the clasp passageway opening in the capture portion (as seen in the right two views in FIG. 2B). The passageway in the capture portion has two opposite side portions which, rather than being parallel to the passageway axis, are in a rounded taper at about 22° in extending from the capture portion to reach the diameter of the round passageway in the cylindrical band fixation portion (as seen in the middle view in FIG. 2B). Again, this passageway permits cloth covered elastomeric band 11 to be pulled therethrough to permit the end of that band to be altered in a selected manner so that it cannot pass through the smaller diameter portion, and the cylindrical shell band fixation portion of male clasp portion 12 here, too, also enables the user of the styling device to hold onto it when connecting together clasp portions 12 and 13 or when disconnecting them from one another.

Thus, one end of cloth covered elastomeric band 11 is anchored at the cylindrical shell portion passageway of male clasp portion 12 and, at the other end of the band, that end is anchored at the cylindrical shell portion passageway of female clasp portion 13 as shown, for example, in FIG. 3. Female clasp portion 13, during engagement with male clasp portion 12, receives male clasp portion 12 within its spherical shell portion and closes thereabout sufficiently for the friction between the two to hold them together against the tension in band 11 to thereby form a toroidal-like structure resembling a rubber band. Providing sufficient separating force between male and female clasp portions 12 and 13 by the user allows them to be separated.

Although the present invention has been described with reference to preferred embodiments, workers skilled in the art will recognize that changes may be made in form and detail without departing from the spirit and scope of the invention.

The invention claimed is:

1. A hair styling device for styling a person's hair through being wrapped about a portion thereof, the hair styling device comprising:

a stretchable, relatively long body portion extending between two ends thereof, and a first end clasp member and a second end clasp member each at a corresponding one of the opposing ends of the body portion with a selected one of the first and second end clasp members having an open region therewith large enough to receive therein a part of the other to be at least in part positionable about that part of the other so as to each capture the other and to remain so positioned against at least a selected amount of force in any subsequently occurring tension between those members that tends to pull them apart, a selected one of the first and second end clasp members having a passageway therethrough into which a corresponding body portion end extends with that body portion end having a passage blocking object thereon and the passageway having at least a part of which that is sufficiently narrow to prevent the body end extending therethrough with a blocking object thereon from passing through that narrow part, wherein the selected one of the first and second end clasp members, as a capturable clasp member, has a capturable portion and a band fixation portion together having a common opening through each to form the passageway therein, the capturable portion having a passageway part extending outward to a greater distance at some location therein than does the passageway part in the band fixation portion to thereby form the narrow passageway part in the band fixation portions of the capturable clasp member, and with that remaining one of the first and second clasp members, as a capturing clasp portion, having a capturing portion with the open region therein and a band fixation portion together having a common opening through each to form a passageway therein that includes the open region, the capturing portion having a resilient wall about the open region except for a capturing portion opening therein but with the open region extending outward to a greater distance with the resilient wall thereabout than does the capturing portion opening, and the capturing portion having a passageway part also extending outward to a greater distance at another location than does the passageway part in the band fixation portion to thereby form the narrow passageway part in the band fixation portion in the capturing portion clasp member.

2. The device of claim 1 wherein each of the first end clasp member and the second end clasp member are of a common material.

3. The device of claim 1 wherein the blocking object is a spherical shaped solid.

4. The device of claim 1 wherein the capturable clasp member has, as a section in the passageway part in the capturable portion thereof, a rounded tapered sides portion about that passageway part which joins a parallel sides opening portion about the passageway part in the band fixation portion thereof, and wherein the capturing clasp member has, as a section in the passageway part in the capturing portion thereof, a rounded tapered sides portion adjacent to the open region about that passageway part which joins a parallel sides opening portion about the passageway part in the band fixation portion thereof.

5. The device of claim 4 wherein the blocking object is a spherical shaped solid.

6. The device of claim 5 wherein an end of the body portion is in a loop with the spherical shaped solid between the sides of the loop together positioned between the tapered sides portion of the capturable clasp member, and wherein the remaining end of the body portion is in a loop with another spherical shaped solid between the sides of that loop together positioned between the tapered sides portion of the capturing clasp member.

7. The device of claim 6 wherein the spherical shaped solid is formed of metal, and the capturable and capturing clasp members are each formed of a polymeric material.

8. The device of claim 7 wherein each of the capturable clasp member and the capturing clasp member are of a common material.

9. The device of claim 6 wherein the spherical shaped solid has a diameter that is less than that maximum distance occurring between the tapered sides in the tapered sides portions of the capturable and capturing clasp members.

10. The device of claim 6 wherein the body portion extends between the two ends thereof without any portion thereof extending through a loop formed by another part of the body portion crossing over yet another part of the body portion.

11. The device of claim 1 wherein each of the capturable clasp member and the capturing clasp member are of a common material.

12. The device of claim 1 wherein the blocking object is a spherical shaped solid.

13. The device of claim 1 wherein the body portion extends between the two ends thereof without any portion thereof extending through a loop formed by another part of the body portion crossing over yet another part of the body portion.

14. The device of claim 1 wherein the body portion extends between the two ends thereof without any portion thereof extending through a loop formed by another part of the body portion crossing over yet another part of the body portion.

* * * * *

UNITED STATES PATENT AND TRADEMARK OFFICE

CERTIFICATE OF CORRECTION

PATENT NO. : 7,337,786 B2
APPLICATION NO. : 11/071883
DATED : March 4, 2008
INVENTOR(S) : Lois J. Sonstegard et al.

It is certified that error appears in the above-identified patent and that said Letters Patent is hereby corrected as shown below:

Column 6, Line 51, delete "14. The device of claim 1"
insert --14. The device of claim 4--

Signed and Sealed this

Twenty-fifth Day of November, 2008

JON W. DUDAS
*Director of the United States Patent and Trademark Office*